United States Patent [19]

Barouh et al.

[11] 3,930,697

[45] Jan. 6, 1976

[54] DISPENSER FOR STRIP MATERIAL

[76] Inventors: Victor Barouh, 935 Plum Tree Road West, Westbury; Robert Glenn, 400 E. 56th St., New York, both of N.Y.

[22] Filed: Jan. 3, 1975

[21] Appl. No.: 538,413

[52] U.S. Cl. ..... 312/39; 206/225; 206/409; 242/55.3; 242/55.53; 312/284

[51] Int. Cl.[2] ..... B65H 19/00

[58] Field of Search ..... 221/25, 30, 70; 206/216, 206/225, 359, 389, 391, 402, 403, 404, 408, 409, 494; 242/55.3, 55.53; 225/39, 44, 45, 46, 53, 77, 88; 312/39, 284

[56] References Cited

UNITED STATES PATENTS

| | | | |
|---|---|---|---|
| 2,333,378 | 11/1943 | Jackson | 225/53 X |
| 2,787,014 | 4/1957 | Barry | 225/88 X |
| 3,869,094 | 3/1975 | Weick et al. | 242/55.53 |

FOREIGN PATENTS OR APPLICATIONS

| | | | |
|---|---|---|---|
| 668,203 | 8/1963 | Canada | 225/44 |

*Primary Examiner*—Robert B. Reeves
*Assistant Examiner*—Joseph J. Rolla
*Attorney, Agent, or Firm*—Kenneth S. Goldfarb

[57] ABSTRACT

A dispenser for strip material comprising a receptacle having an arcuate well for a reservoir roll of strip material, a cover overlying said receptacle for receiving a feed roll of strip material. A base is secured to said receptacle defining a compartment for receiving strips of material torn from said feed roll for future use thereof. The base has upwardly extending flanges and a partition for removably clampingly engaging said receptacle while defining a compartment for receiving the strips of material.

10 Claims, 7 Drawing Figures

FIG. 3
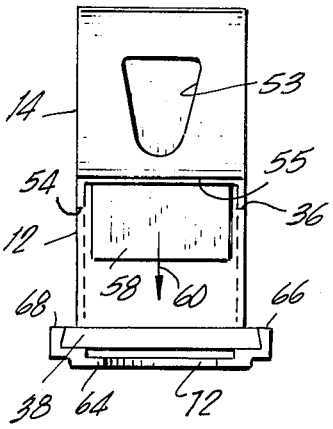
FIG. 4
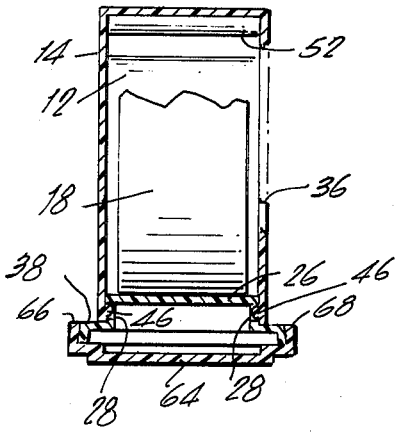
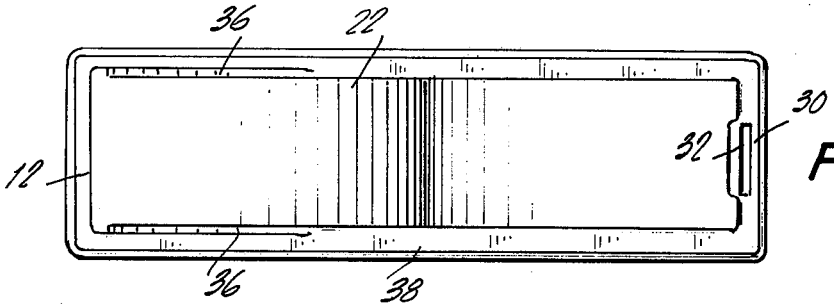
FIG. 5
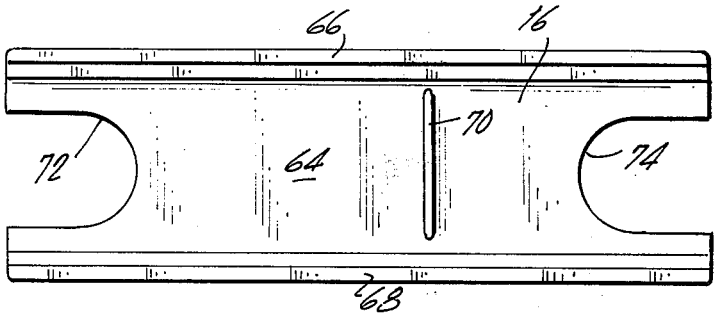
FIG. 6
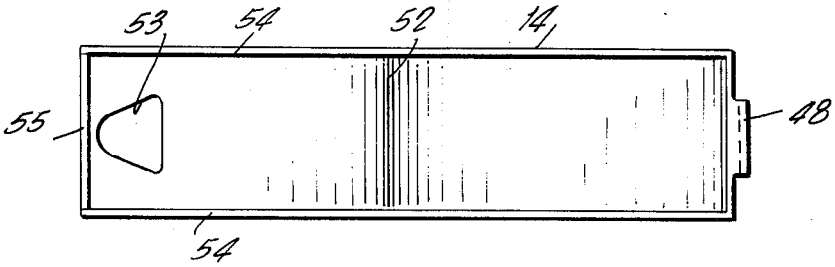
FIG. 7

DISPENSER FOR STRIP MATERIAL

BACKGROUND OF THE INVENTION

1. Field of the Invention

This invention relates to the class of material dispensing, and more particularly to a dispenser for strip material.

2. Description of the Prior Art

Typewriter correction material in the form of a substrate such as paper which is coated with an opaquing composition carefully pigmented to conform to the color of typewriting paper has been widely used for correcting errors. This typewriter correction material has also been manufactured in elongated strips formed into rolls and used in connection with a desk dispenser such as that disclosed in United States Design Pat. No. 214,405 of Jack Fairchild-Fleming, issued June 10, 1969 for TAPE DISPENSER.

When using a desk dispenser for typewriter correction strip material, the typist will tear a piece of the strip material of convenient size from the dispenser, for example, of between one to two inches in size. Then, the typist will make the desired corrections using the typewriter correction material. After one or several strikes of the typewriter keys on the typewriter correction material, the typist is then ready to continue normal typing. The already used strip of typewriter correction material may be used thereafter again and reused a number of times for many corrections, but because there generally is no convenient place to store this piece of typewriter correction material, it may be discarded or left on the desk where it may become soiled, messed or dirty or where powdered correction material from the strip may cause soiling of other paraphernalia.

Accordingly, it is one object of this invention to provide a convenient place for storing in a readily accessible manner the torn off and partially used pieces of typewriter correction material.

In a dispenser of the prior art as above described, considerable amounts of plastics are used while providing a limited storage area for typewriter correction material. It is therefore another object of the present invention to provide means which also serve to facilitate the storage of a reservoir roll of typewriter correction strip material, while also, if desired, reducing the necessary size of the dispenser, while even increasing the amount of typewriter material capable of being stored therein.

In the past typewriter correction material has been sold under a brand called "Sweetheart" which employed dispensers having an outer configuration simulating at least the upper portions of a conventional heart. The present invention carries out this configuration while also achieving the unexpected advantage of providing for an internal guide for the strip material being dispensed.

SUMMARY OF THE INVENTION

The concept of the present invention is to provide a dispenser for typewriter correction strip material having three main parts, a housing, a cover, and a base. The housing is provided with an elongated support ledge on which a feed roll of strip material is positioned and then fed over an arcuate curved surface of the receptacle. The cover has an arcuate portion which lies closely to the curved surface of the receptacle for guiding and feeding tape material from the feed roll. The base is clampingly secured to the receptacle and retains a reservoir roll between the base and the receptacle while also forming a compartment for receiving pieces of correction material. The upper configuration of the cover is in the shape of the upper portion of a heart forming a guide for the strip material from the feed roll. The heart configuration also provides for conveniently positioning the rolls of material thereby reducing the amount of plastic needed since the size of the dispenser is minimized in proportion to the amount of material contained therein.

Still further objects and features of the invention reside in the provision of a desk dispenser that is simple in construction, capable of being conveniently molded out of readily available plastic materials, which is inexpensive, yet which is highly attractive in appearance and convenient to handle.

These, together with the various ancillary objects and features of this invention, will become apparent as the following description proceeds, are attained by this dispenser for strip material, a preferred embodiment of which is illustrated in the accompanying drawings, by way of example only, wherein:

BRIEF DESCRIPTION OF THE DRAWINGS

FIG. 3 is an end elevational view of the dispenser looking along the plane of line 3—3 in FIG. 2;

FIG. 4 is a vertical sectional view taken along the plane of line 4—4 in FIG. 2;

FIG. 5 is a top plan view of the receptacle looking along the planes of line 5—5 in FIG. 1;

FIG. 6 is a top plan view of the base looking along line 6—6 in FIG. 1; and FIG. 7 is a bottom plan view of the cover looking along the plane of line 7—7 in FIG. 1.

DETAILED DESCRIPTION OF THE PREFERRED EMBODIMENT

Figure 1:
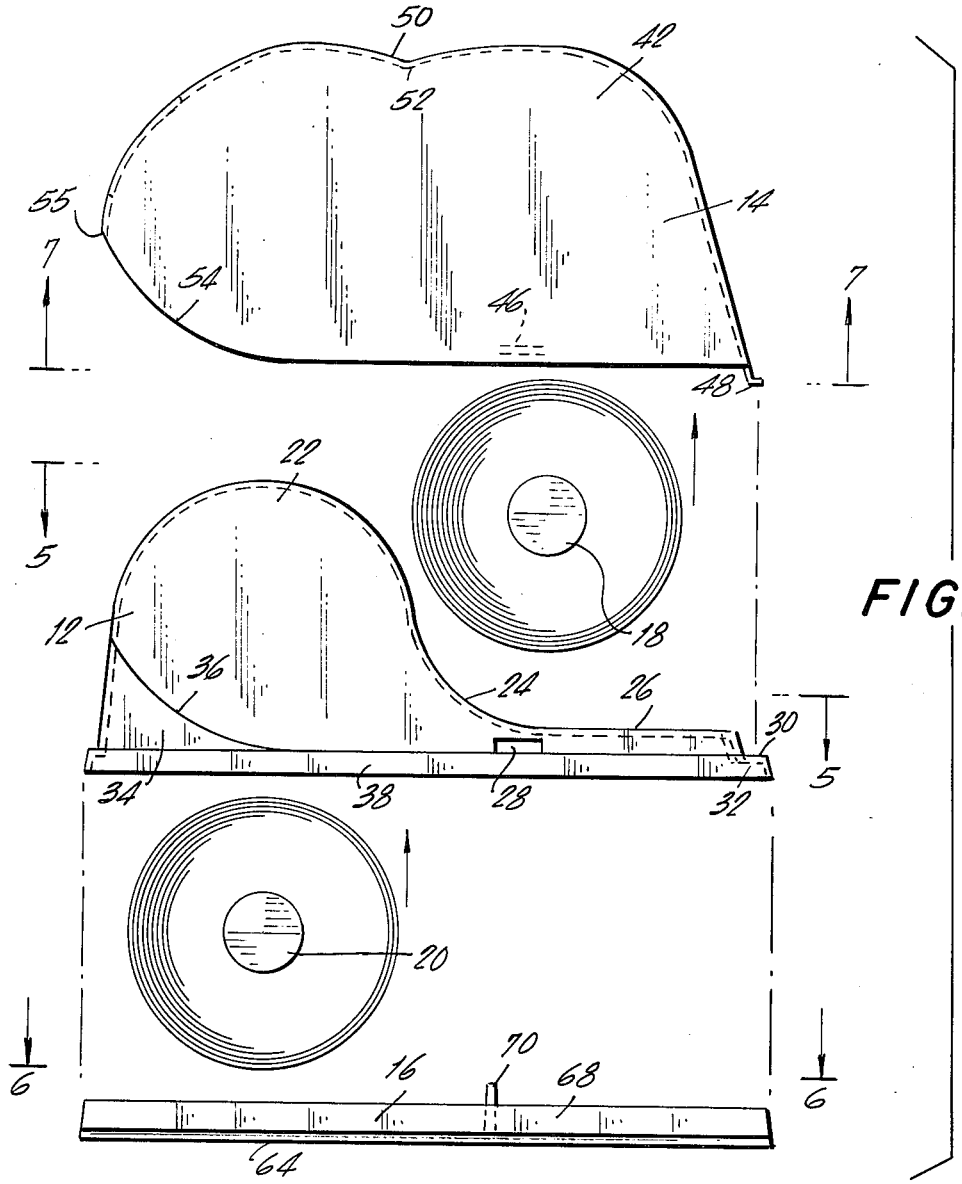
FIG. 1 is an exploded elevational view of a dispenser constructed in accordance with the concepts of the present invention.
Figure 2:
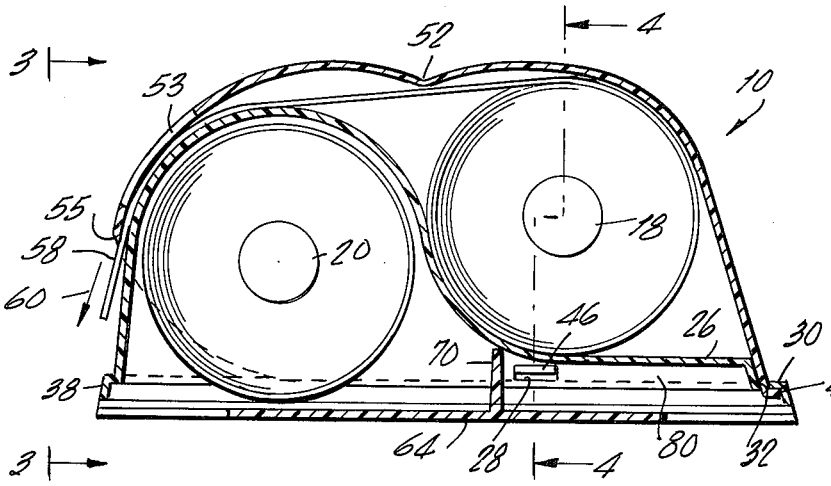
FIG. 2 is a longitudinal sectional view of the assembled dispenser.

With continuing reference to the accompanying drawings, wherein like reference numerals designate similar parts throughout the various views, the dispenser in accordance with the invention is generally indicated by reference numeral 10, employs three main members, including a receptacle 12, a cover 14, and a base 16. These parts combine to store and mount a feed roll of strip material 18 and a reservoir roll of strip material 20.

The base includes an upwardly extending arcuate well 22 open at the bottom and which fairs by way of an arcuate concave lower portion 24 into an elongated support ledge 26. The receptacle is provided with opposed recesses 28 and the ledge is provided with a step portion 30 having an opening therein. The receptacle is provided with a lower portion 34 having an arcuate concave surface 36 and has a slightly wider bottom 38.

The cover 14 is also open at the bottom and provided with opposed side walls 42 and 44 having detents 46 which are adapted to seat within the recesses 28 and having an L-shaped detent 48 adapted to pass through the opening 32 to form an interlock. The upper portion of the cover 14 has a top wall 50 contoured to conform in shape to the upper portion of a conventional heart, thus forming a downwardly extending guide apex 52.

The lower portion of the cover is convexly contoured at 54 complementary to the surfaces 36 and the cover is designed to be closely spaced to the upper portion 22 of the receptacle for guiding strip material 58 from the feed roll 18 in the direction of arrow 60, while also serving to form a hand hole for facilitating removal of the cover from the receptacle. The cover is also provided with an access opening 53 enabling the typist to guide and feed the strip material and pull it through until the desired amount has been fed off the feed roll from whence it may be conveniently torn using the bottom edge 55 of the top wall 50 for this purpose. The reservoir roll 20 is adapted to fit in the portion 22 of the receptacle 12 and is held in place.

The base 16 includes a bottom plate 64 having a pair of upwardly extending stepped flanges 66 and 68 and has a partition 70 spaced from the flanges 66 and 68 and extending normal thereto. A pair of finger holes 72 and 74 open into the sides of the plate 64.

When the parts are assembled, the base forms a compartment 80 defined by the support ledge 26, the sides of the receptacle 12, the partition 70, and the bottom plate 64, and torn off strips of correction material may be easily inserted using the finger hole 74 for future use and then easily removed therefrom. The reservoir roll 20 remains fresh and uncontacted by the used or partially used strips of correction material because of the partition 70. However, once the reservoir roll 20 has been used to replace the feed roll 18, pieces of correction material may also be stored in the area previously reserved for the reservoir roll through the finger hole 72. The cover 14 may be easily removed by pushing up at the edge 55 and thereafter disengaging the detent 48. The flanges 66 and 68 together with the partition serve to clampingly hold the base to the receptacle.

A latitude of modification, change and substitution is intended in the foregoing disclosure, and in some instances some features of the invention will be employed without a corresponding use of other features.

We claim:

1. A dispenser for strip material comprising a receptacle having an elongated support for supporting a feed roll of strip material, a cover overlying said receptacle and enclosing said feed roll of strip material, said receptacle and said cover having cooperating closely adjacent arcuate surfaces between which strip material is led, and a base detachably secured to said receptacle for forming in combination with said receptacle a storage compartment for storing strips of material removed from said feed roll of strip material.

2. A dispenser for strip material comprising a receptacle having an arcuate well open at the bottom for receiving a reservoir roll of strip material and having an elongated support ledge for supporting a feed roll of strip material, a cover overlying said receptacle and enclosing said feed roll of strip material, said receptacle and said cover having cooperating closely adjacent surfaces between which strip material is led, and a base detachably secured to said receptacle for forming in combination with said receptacle a storage compartment for storing strips of material removed from said feed roll of strip material, said base retaining said reservoir roll within said receptacle.

3. A dispenser according to claim 2, wherein said base has upwardly extending side flanges for clampingly engaging said receptacle.

4. A dispenser according to claim 3, wherein said base has finger holes in the opposite ends thereof for facilitating depositing strips of material torn from said feed roll between said receptacle and said base and for facilitating removal of said base from said receptacle.

5. A dispenser according to claim 4, including means for separating said compartment from said reservoir roll.

6. A dispenser according to claim 2, wherein the top of said cover is of a generally upper heart shaped configuration having a downwardly depending feed guide for strip material from said feed roll.

7. A dispenser according to claim 2, wherein said base has upwardly extending resilient side flanges and a partition extending normal to said flanges and spaced therefrom, said receptacle being clampingly held between said flanges and said partition separating said compartment from said reservoir roll.

8. A dispenser according to claim 7, wherein said base has finger hole means for providing access to said compartment.

9. A dispenser according to claim 7, wherein said base has finger holes in the opposite ends thereof for facilitating depositing strips of material torn from said feed roll between said receptacle and said base and for facilitating removal of said base from said receptacle.

10. A dispenser according to claim 9, wherein the top of said cover is of a generally upper heart shaped configuration having a downwardly depending feed guide for strip material from said feed roll.

* * * * *